US005470430A

United States Patent [19]

Lewis et al.

[11] Patent Number: 5,470,430

[45] Date of Patent: Nov. 28, 1995

[54] MASKING APPARATUS

[76] Inventors: Tommy D. Lewis, P.O. Box 2966, Santa Cruz, Calif. 95063; Keith V. Leisses, 435 Park Dr., Ben Lomond, Calif. 95005

[21] Appl. No.: 335,470

[22] Filed: Nov. 7, 1994

[51] Int. Cl.[6] ..... B32B 31/00

[52] U.S. Cl. ..... 156/577; 156/522; 156/523; 156/579

[58] Field of Search ..... 156/523, 526, 156/527, 530, 554, 577, 579, 574, 522

[56] References Cited

U.S. PATENT DOCUMENTS 3,186,892 6/1965 Walthers ..... 225/89
3,745,086 7/1973 Parker ..... 156/527
3,930,927 1/1976 Thompson et al. ..... 156/530
4,344,813 8/1982 Holoff et al. ..... 156/577 X
4,915,768 4/1990 Soderberg ..... 156/579 X

*Primary Examiner*—James J. Engel
*Attorney, Agent, or Firm*—Jeffrey A. Hall

[57] ABSTRACT

An improved taping and masking apparatus to aid in the masking of windows, frames, and other surfaces includes a cutter mounted to a frame and linked to a trigger element by a control assembly having a transverse shaft, support boss, advance pivot and cutter pivot. A handle assembly allows for both left and right handed operation of the apparatus and is positioned adjacent to the trigger element. Dispensing elements are rotatably mounted to the frame and configured to hold one or more rolls of taper, paper, or other sheet material. A safety element shields the user from the cutting blade allowing for safe and efficient cutting of tape, paper, or other sheet material.

5 Claims, 2 Drawing Sheets

MASKING APPARATUS

BACKGROUND OF THE INVENTION

1. Field of Invention

This invention relates to masking machines, and particularly to apparatuses of the type adapted for dispensing sheet material such as tape, paper, film, hot-melt microprint, and the like, for use in masking surfaces.

2. Description of the Related Art

Various taping and masking apparatuses have been proposed and implemented to effect finish procedures such as painting and trimming. Typically, the apparatuses dispense sheet material and tape for application to a surface for protection from paint or other finish material applied to an adjacent surface. Common examples of such application is in building finishing and painting operations and in finishing operations on consumer products such as automobiles, bicycles, and the like.

Taping and masking machines are commercially available in a wide variety of sizes and configurations for use in different applications. For example, apron machines are large, cumbersome apparatuses which are stationary mounted and dispenses an apron of taped sheet for application to a remote surface. Also available are compact and hand held masking machines for application of sheet material and tape which are dispensed as the machine is moved over a surface.

Prior masking and taping apparatuses have typically included a frame with a holder for carrying a roll of coiled sheet material and another holder for supporting a roll of coiled, pressure sensitive tape. Usually, such holders are rotatably mounted on spindles and have a parallel axis of rotation so that the tape is applied along and overlapping an edge of the sheet material during dispensing. A cutting edge is typically carried by the frame, usually extending parallel to the axis of the holder, for cutting the tape and sheet material. Various handle assemblies have been provided for the hand held apparatuses.

Most prior masking and taping apparatuses have been designed for use in combination with sheet material and tape having defined widths. Although the larger apron machines could accommodate sheet material of substantial width, typically masking and taping machines are configured for tape and sheet material typically of widths from about one-half inch to eighteen inches. The sheet material has conventionally been composed of relatively heavyweight paper coiled about a paper core. Tapes of various widths and having different adhesive backings have been proposed and implemented with such apparatuses.

More recent developments in this area have attempted to increase the versatility of taping and masking machines by use adapting their use to plastic materials, such as polyethylene and the like which can be folded and refolded before being coiled. This results in sheet material having widths several times the limits of earlier apparatuses.

Current state of the art hand held type apparatuses include a roll-feed for paper and another for tape with a side handle assembly. Such apparatus typically has a serrated cutter and the operator must attach the sheet material or tape to the work surface and pull toward the lower edge of the surface to be protected. The operator must then lift the sheet material or tape away from the surface and tear the sheet material or tape against the blade. In a windy environment, which is common on exteriors of large buildings, the sheet material or tape will catch the wind and billow because the sheet material or tape is attached on only one side. The sheet material or tape can then easily attach to the wrong surface or wrong position and cause significant additional work and lost time. When film and other light weight materials are used this is a major problem. Such limitations of prior apparatuses significantly detract from their effectiveness and value.

Accordingly, it is the primary purpose of this invention to provide an improved taping and masking apparatus which is hand held and which can be used safely, with precision and accuracy, to apply sheet material such as paper, film, tape, hot-melt microprint, and the like, to a surface while allowing the user to cut the sheet material or tape while the apparatus is on the surface. The apparatus allows cutting material with square corners so that no tearing is required, and paper, tape, or other sheet material is loaded from the top of the apparatus and means provided to automatically advance the paper, tape, or sheet material after cutting. The apparatus of the present invention also has a centrally positioned handle assembly mounted in the center of the width of the apparatus allowing for convenient use by both left and right handed people. The apparatus of the invention may be used with either one or two rolls of sheet or taping material and the sheet material or tape may be applied on either the right and or left hand edges of the sheet material or tape with ease, convenience and efficiency. The present apparatus is also inexpensive to clean, use, and manufacture.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purpose of the invention as embodied and broadly described herein, an improved taping and masking apparatus of the type in which a frame holds a roll holder rotatably carried by the frame for supporting a roll of tape is provided where the improvement, comprises cutting means for cutting the tape or paper without removing the apparatus from a work surface. A handle means allowing for both right and left handed operation of the masking and taping apparatus is centrally mounted on the frame. Dispensing means are provided for dispensing the tape or paper from the apparatus and may be easily and conveniently used with either on or two rolls of tape. For safe and efficient cutting and dispensing of the tape and paper, safety means are provided for protecting the user from accidental cuts or abrasion from the cutting means.

The taping and masking apparatus of the present invention is preferably provided as a hand held apparatus, however, the concepts disclosed herein may be applied to larger versions of the apparatus without departing from the spirit or scope of the invention. The taping and masking apparatus of the present invention is preferably composed of a durable, resilient material, such as metal, plastic, composite, or the like, with resilient thermoplastics being preferred.

In accordance with the present invention there also is provided a taping and masking apparatus for taping and masking of work surfaces. In this embodiment, the taping and masking apparatus includes a frame, a roll holder rotatably mounted on the frame with cutting means proximately positioned to said roll holder. Handle means are provided for holding and positioning the taping and masking apparatus and are centrally positioned and mounted in substantially the center of the width of the frame so as to allow both right and left handed operation of the apparatus. Dispensing means for controlled dispensing of tape, paper or other sheet material is provided operably mounted on the frame and includes automatic advancement means for advancing the paper, tape, or other sheet material after cutting. To assure safe and efficient operation of the apparatus safety means are provided to protect the user from accidental cuts or abrasions, thereby allowing for safe and efficient cutting of the tape and paper. The taping and masking apparatus of the present invention is top loaded with paper or other sheet material, and cutting means allow for cutting square corners at a predictable easy to position location so that no tearing is required. The present invention may be used with a wide variety of paper and tape widths conveniently and with great efficiency.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DESCRIPTION OF THE PREFERRED EMBODIMENTS

Reference will now be made in detail to the present preferred embodiments of the invention as illustrated in the accompanying drawings.

In accordance with the present invention, there is provided an improved taping and masking apparatus of the type in which a frame holds a roll holder rotatably carried by the frame for supporting a roll of tape or paper, wherein the improvement, comprises: cutting means for cutting said tape without removing said apparatus from a work surface; said cutting means being operably mounted on said frame; said cutting means including an elongated cutting element operably linked to a control assembly by a cutter pivot element; handle assembly means allowing for both right and left handed operation of said taping apparatus; said handle assembly means including a centrally positioned handle operably mounted on said frame; said handle assembly means being positioned adjacent to a trigger element, said trigger element being operably linked to said control assembly; dispensing means for dispensing said tape, said dispensing means allowing for dispensing tape from either one or two rolls of tape simultaneously; said tape dispensing means being operably secured to said frame and including a rotatable tape holding element and a rotatable paper holding element rotatably mounted on the frame; and safety means for shielding said cutting means, allowing for safe and efficient cutting of said tape; said safety means being operably secured to said elongated cutting element and to said control assembly.

In another embodiment of the invention, a taping and masking apparatus is provided, for the taping and masking of work surfaces, comprising: a frame; a roll holder rotatably mounted on said frame; cutting means for cutting tape and paper into selected lengths; said cutting means including a cutting element secured to a control assembly by a cutter pivot element; handle means for holding and positioning of said taping and masking apparatus, said handle means being operably mounted on said frame and including a centrally positioned handle operably mounted on said frame and proximately positioned to a trigger element: dispensing means for controlled dispensing of said tape and paper, said dispensing means being mounted on said frame and including a rotatable tape holding element and rotatable paper holding element mounted on the frame; and safety means for enclosing and shielding said cutting means, thereby allowing for safe and efficient cutting of the tape and paper.

Figure 1:
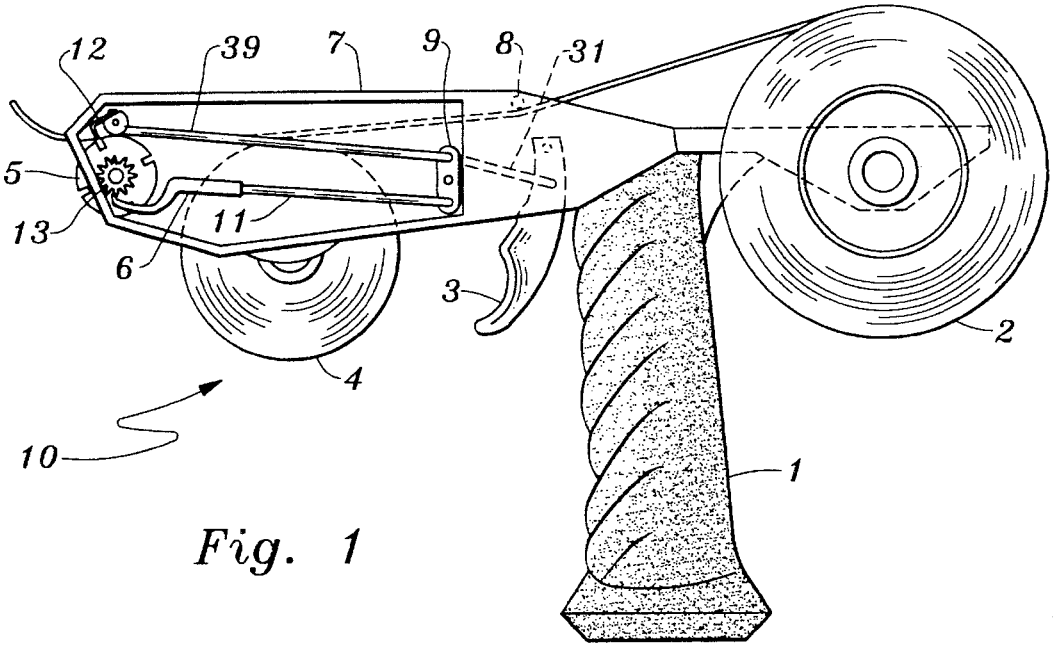
FIG. 1 is a perspective view of the taping and masking apparatus, according to the invention.

In FIG. 1, the taping and masking apparatus 10 is shown with a handle assembly including handle 1, frame 7 with tape guide roller 8 mounted thereto, and trigger element 3, with roll of tape 2 and roll of paper 4 supported thereon. Handle 1 is preferably configured to adapt to a human hand grip and is positioned extending substantially perpendicular to frame 7. Handle 1 is positioned in the center of the width of frame 7 allowing for either left or right-handed operation of apparatus 10 and is substantially symmetrical thereby contributing to the balance of apparatus 10. Frame 7 is preferably composed of a durable resilient material such as plastic, composite, metal, or the like, with a durable thermoplastic being preferred.

Figure 2:
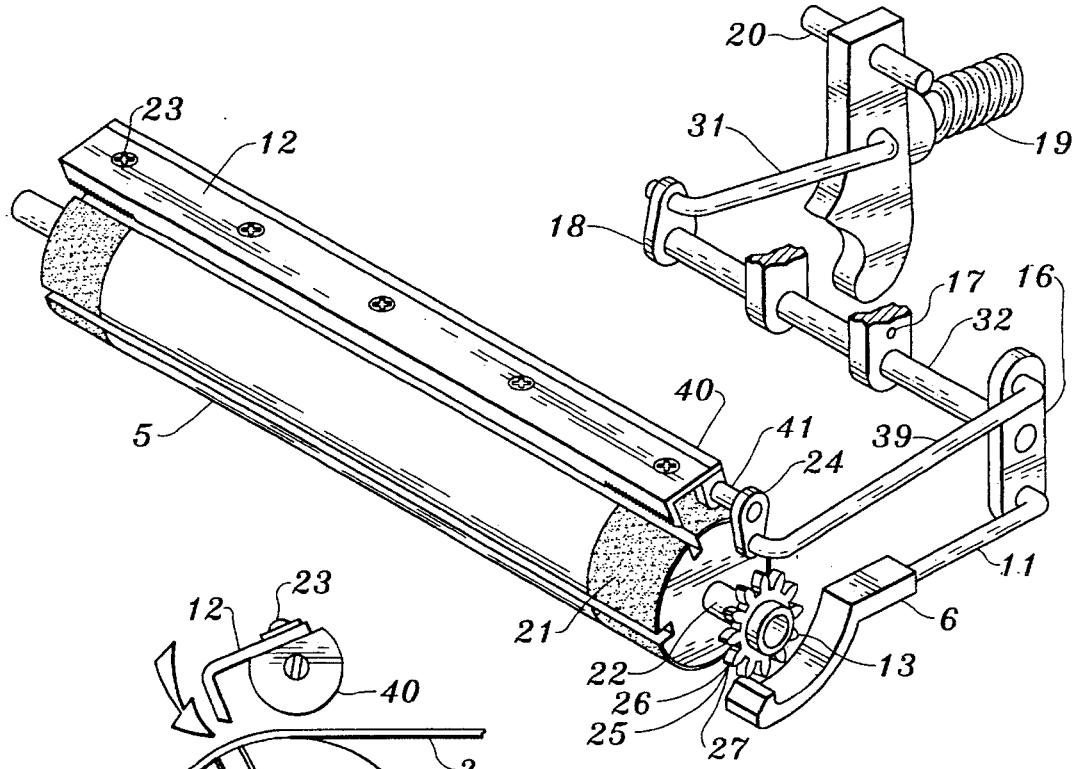
FIG. 2 is a perspective view of the cutter and control assembly separated from the frame, according to the invention.

Best seen in FIGS. 1 and 2, are cutting means for cutting tape 2 and paper 4 allowing for cutting the tape or paper without removing apparatus 10 from a work surface. Cutting means are preferably provided by cutter blade 12 operably mounted on frame 7 by screws 23 or other mechanical fastening means such as bolts, rivets, welds or the like. Cutting blade 12 is preferably an elongated element composed of a durable resilient material such as a metal and is operably linked to a control assembly communicatively linked to trigger 3 which is moveably mounted to trigger shaft 20 and spring 19. The control assembly preferably includes trigger push rod 31 secured to trigger 3 and lever arm 9 and 18. Lever arm 18 is operably secured to transverse shaft 32 with support boss 17 supporting shaft 32. Lever arm 16 is operably secured to shaft 32 and arm linkage rod 11 and 39. Linkage rod 11 preferably has powl arm 6 at a terminal end thereof and is positioned adjacent to and in operable combination with gear assembly 13. Arm 39 is preferably secured to lever arm 24 which is operably attached to shaft 41 and bar element 40. Bar element 40 is secured to cutting blade 12 by screws 23, bolts, rivets, or other mechanical fastening means.

Cutting blade 12 is preferably positioned in operable proximity to roller cutting guide 5 which includes, in the preferred embodiment, an embossed surface 21, and is linked to gear assembly 13 by shaft 22. Gear assembly 13 includes advance gear 25 and mounting elements washer 26, captive fastener 27, and roller cutter guide slot 28, best seen in FIG. 2. Cutting blade 12 allows for precision cutting of tape and paper with square corners so that no tearing or ripping of the paper or tape is required without removing apparatus 10 from a work surface.

Figure 3:
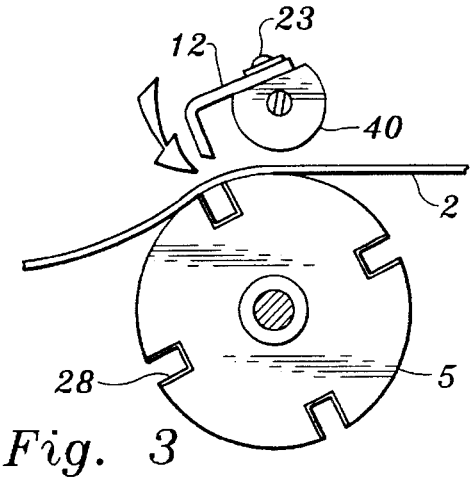
FIG. 3 is an exploded end view of the cutter, cutter guide, and cutter guide slots, according to the invention.

Referring now to FIG. 3, roller 5 is shown with cutting guide slots 28 for the positioning of tape or paper on roller 5. Cutting blade 12 is seen secured to bar element 40 by screw 23. As tape or paper is pulled along roller 5 the user cuts the tape or paper at a selected length by pulling trigger 3 which, as previously described is operably linked to cutting blade 12 by arms 31, 32, 11, and 39, thereby cutting the tape or paper at a desired length. After cutting, the paper or tape is automatically advanced by gear assembly 13 operably linked to roller 5 and powl arm 6. Safety means for shielding cutting blade 12 thereby allowing for safe and efficient cutting of tape or paper is preferably provided by bar element 40 secured to cutting blade 12 and lever arm 24.

Figure 4:
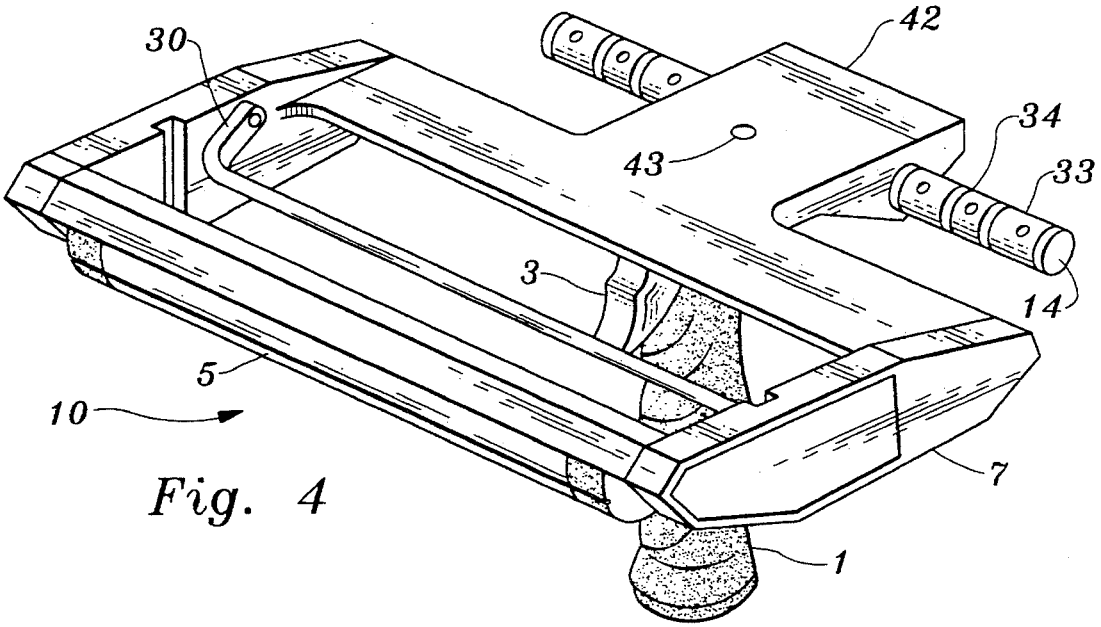
FIG. 4 is a bottom view of such apparatus showing the tape mounting rod, frame, handle, and trigger element according to the invention.

In FIG. 4, dispensing means for dispensing tape is provided by a rotatable tape holding element 14 operably mounted to frame 7. Tape holding element 14 is preferably provided with tape width markings 33 and a plurality grooves 34 which function as tape width snap stops, thereby allowing for the positioning and securing of one or more rolls of tape on tape holding element 14. As seen in FIG. 4, tape holding element is preferably mounted on extension 42 secured to tension arm 30 of frame 7, which extends from frame 7 and includes substantially planar surface 43.

Figure 5:
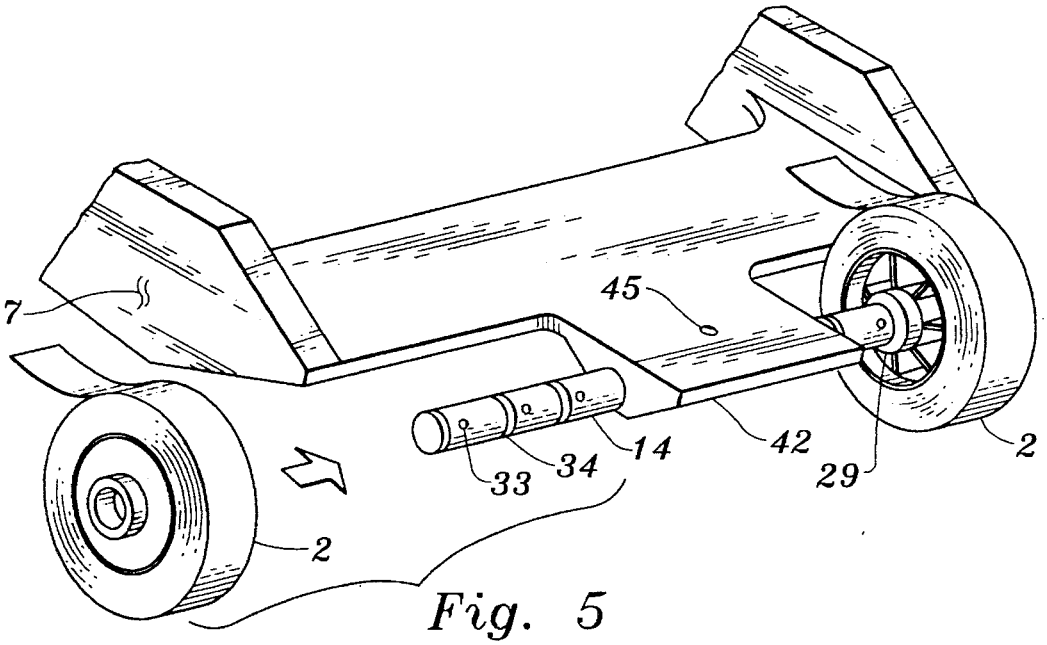
FIG. 5 is a perspective view of the tape mounting rod, tape mounting wheel, stop-channels, and tape width markings, according to the invention.

Referring now to FIG. 5, a tape mounting wheel 29 for holding tape 2 is shown on tape holding element 14, secured to extension 42 and tension arm 30 of frame 7. Apparatus 10 may be used with either one or two rolls of tape, and tape may be applied on the right and/or left hand edges of the paper or film being applied by loading either one or both ends of tape holding element 14 with a roll of tape. Further, multiple tape widths can be accommodated with groove stops 34, for example, tape from ¼ inch to 2 inches is easily accommodated, and paper from 6 inches to 12 inches conveniently used. Of course, other size paper and tape may be used, however, these are typical dimensions for the hand-held version of apparatus 10.

Figure 6:
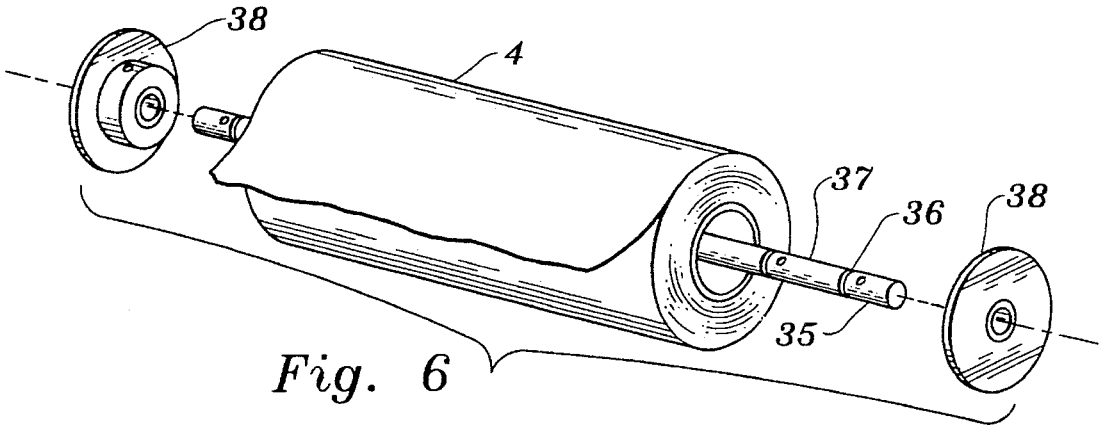
FIG. 6 is a perspective view of the paper mounting rod, stop-channels, and paper width markings, according to the invention.

In specific reference to FIG. 6, a paper holding element 37 for holding and positioning paper roll 4 is shown with paper width markings 35 and groove stops 36. Paper holding element 37 may accommodate one or two rolls of paper and may be applied on the right and/or left side of the work surface. As previously discussed, multiple paper widths can be accommodated on paper holding element 37 and groove stops 36, and paper rolls 4 are preferably mounted on a paper mounting wheel 38 as shown. Paper is automatically advanced after cutting with cutting blade 12 by gear assembly 13 and arm 39 and 11 with powl arm 6.

In operation and use tape and masking apparatus 10 allows dual taping so that the paper or film being used is completely secured to the work surface when needed. The advance cutting mechanism takes the guess work out of where to cut and does not require movement of apparatus 10 off of a work surface during cutting procedures. This results in significantly less paper waste than prior apparatuses, is highly efficient in windy conditions and eliminates the need to rework a surface. Apparatus 10 also provides a very fast and efficient taping and masking means because the paper is fully supported and the tape and paper holding and guiding elements properly aligns the tape and paper and thereby affixes the tape to the paper. Cutting blade 12 completely overlaps the paper and tape combination thereby assuring a square cut corner so that no tearing or ripping is required. Moreover, the symmetrical, centrally positioned handle allows for both left and right handed operation of apparatus 10 and results in a balanced tool both extremely efficient and safe to use.

As is evident from the above description, a wide variety of designs or configurations of taping and masking apparatus 10 may be fashioned from the present invention. For example, various sizes and configurations of apparatus 10 can be provided in accordance with the present invention. Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. An improved taping apparatus of the type in which a frame holds a roll holder rotatably carried by said frame for supporting a roll of tape and paper, wherein the improvement, comprises:

cutting means for cutting said tape without removing said apparatus from a work surface; said cutting means being operably mounted on said frame; said cutting means including an elongated cutting element operably linked to a control assembly by a cutter pivot element;

handle assembly means allowing for both right and left handed operation of said taping apparatus; said handle assembly means including a centrally positioned handle operably mounted on said frame; said handle assembly means being positioned adjacent to a trigger element, said trigger element being operably linked to said control assembly;

dispensing means for dispensing said tape and paper, said dispensing means allowing for dispensing tape and paper from either one or two rolls of tape simultaneously; said tape dispensing means being operably secured to said frame and including a rotatable tape holding element and a rotatable paper holding element mounted on the frame; and safety means for shielding said cutting means allowing for safe and efficient cutting of said tape; said safety means being operably secured to said elongated cutting element and to said control assembly.

2. The improved taping apparatus of claim 1, wherein said cutting means comprises a cutter blade positioned adjacent to a cutter guide operably linked to a gear assembly.

3. The improved taping apparatus of claim 1, wherein said handle assembly means comprises an elongated handle element adapted to be held by a human hand and extending substantially perpendicular to said frame.

4. The improved taping apparatus of claim 1, wherein said rotatable tape holding element comprises a tape mounting rod having a plurality of grooves therein allowing for positioning and securing one or more rolls of tape thereon.

5. The improved taping apparatus of claim 1, wherein said safety means comprises an elongated bar element secured to said cutter blade and to said cutter pivot point element.

* * * * *